US007784960B2

(12) United States Patent
Lahtinen

(10) Patent No.: US 7,784,960 B2
(45) Date of Patent: Aug. 31, 2010

(54) LED LIGHT FOR HEADGEAR

(76) Inventor: Matti Lahtinen, Arpalahdentie 210, FIN-25410 Suomusjärvi (FI)

( * ) Notice: Subject to any disclaimer, the term of this patent is extended or adjusted under 35 U.S.C. 154(b) by 0 days.

(21) Appl. No.: 10/563,911

(22) PCT Filed: Jul. 12, 2004

(86) PCT No.: PCT/FI2004/000446

§ 371 (c)(1),
(2), (4) Date: Jan. 10, 2006

(87) PCT Pub. No.: WO2005/005882

PCT Pub. Date: Jan. 20, 2005

(65) Prior Publication Data

US 2006/0158869 A1 Jul. 20, 2006

(30) Foreign Application Priority Data

Jul. 11, 2003 (FI) ..... 20031059

(51) Int. Cl.
*F21V 21/084* (2006.01)

(52) U.S. Cl. ..... 362/105; 362/106; 362/107

(58) Field of Classification Search ..... 362/105–107
See application file for complete search history.

(56) References Cited

U.S. PATENT DOCUMENTS 4,298,913 A * 11/1981 Lozar ..... 362/106
4,406,040 A 9/1983 Cannone
5,086,378 A 2/1992 Prince
5,124,892 A 6/1992 Lambert
6,302,570 B1 * 10/2001 Petell et al. ..... 362/554
6,459,919 B1 * 10/2002 Lys et al. ..... 362/234
6,659,618 B2 12/2003 Waters
6,733,150 B1 * 5/2004 Hanley ..... 362/106
2002/0021566 A1 * 2/2002 Lee ..... 362/190
2004/0228119 A1 * 11/2004 Becker ..... 362/106

FOREIGN PATENT DOCUMENTS

GB 2 316 429 A 2/1998

* cited by examiner

*Primary Examiner*—Sandra L O'Shea
*Assistant Examiner*—William J Carter
(74) *Attorney, Agent, or Firm*—Birch, Stewart, Kolasch & Birch, LLP

(57) ABSTRACT

A LED illuminator or an equivalent illuminator with a semiconductor light source for a headgear or equivalent, said illuminator comprising one or more light emitting semiconductor light sources (4), especially LEDs (Light Emitting Diode), a frame (1, 2, 11, 12), an electronics control part (5) for controlling the semiconductor light sources, and fastening parts for fastening the illuminator, wherein the semiconductor light sources are directed in at least one given direction, such as towards a working object and/or area, said illuminator being a unitary illuminator module, wherein the semiconductor light sources are fitted in a common, preferably rectangular connection part (3), side by side and directed towards the working object and/or area, and the frame consists of two frame parts (1, 2, 11, 12) folded one over the other, which can be attached to the headgear by means of releasable quick coupling parts, preferably snap-on bayonet catches.

6 Claims, 2 Drawing Sheets

LED LIGHT FOR HEADGEAR

BACKGROUND OF THE INVENTION

1. Field of the Invention

The present invention relates to LED illuminator designed to be attached to a headgear or equivalent and comprising one or more light emitting semiconductor light sources, especially LEDs (Light Emitting Diode), a frame, an electronics control part for controlling the semiconductor light sources, and a fixing part for fixing the illuminator.

2. Brief Discussion of the Related Art

For example in orienteering, when orienteering is done in darkness, forehead-lamps consisting of an incandescent illuminator and a power source attached to a forehead band are used. The forehead-lamp has a good illuminating efficiency, and its placement on the forehead band allows the person to move freely in the terrain and read the map without the person having to carry any hand-held illuminator in his/her hands.

The biggest drawback of present forehead-lamps is the large size of the incandescent illuminators and the high power consumption of the incandescent lamp. This also requires a large power source. In addition, due to the large size of the incandescent illuminators, present forehead-lamps are relatively ugly in appearance.

For example, specification U.S. Pat. No. 6,659,618 discloses an illuminator attached to a cap and using a light source consisting of a number of separate LEDs placed side by side. The LED has a very low power consumption and also a very small size, so it can be used to form illuminators of a relatively small size.

A drawback with the solution disclosed in the aforesaid US specification is that it is difficult to fit the illuminator inside the visor of the cap, and, as it consists of several separate LED units, it also requires a relatively large space.

SUMMARY OF THE INVENTION

The object of the present invention is to overcome the drawbacks of prior art and to create a compact LED illuminator module for a headgear or equivalent that can be easily fixed and allows the illuminator to be very effectively precision-aimed at a desired target.

By using the invention, it is possible to produce precision-directed LED illuminator modules integrated with a headgear, which are applicable for personal use e.g. in caps, surgeon's headgear, helmets, such as protective helmets, and in diving masks.

It is also possible to use different and differently colored light modules, which work together or separately. They may be fixed or movable. They are precision positioned and precision directed in a given direction. The aim is to illuminate the target and to make both hands free for only the intended action, such as e.g. a LED illuminator attached to a cap according to the personal "Led It See" illuminator system as illustrated in FIG. 1. It can also be attached to a helmet or diving mask etc.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawing, which is given by way of illustration only, and thus is not limitative of the present invention, wherein:

FIG. 1 presents a LED illuminator module according to the invention, designed to be attached to a headgear and comprising a frame 1, 2, a rectangular LED unit 3, which for example in FIG. 1 consists of six LEDs 4 placed side by side, and an electronics part 5, which is provided with a switch 6 for switching the illuminator on/off. A battery or the like for the supply of electric power to the illuminator can be mounted separately and is not shown in FIG. 1. In an embodiment, as shown in FIG. 4, the LED illuminator including the LED unit 3 can be located at a cap 41 with a visor 42.

Figure 1:
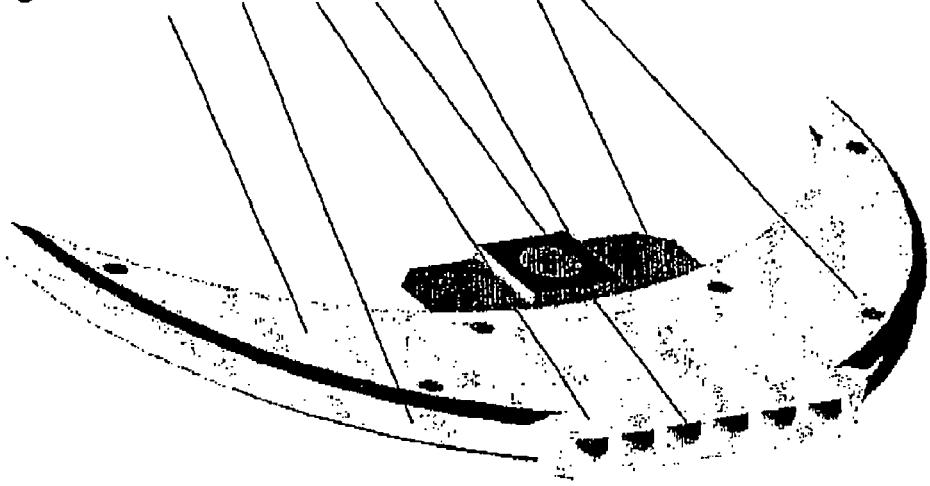
FIG. 1 presents a LED illuminator attached to a cap or equivalent.

The frame 1, 2 consists of two curved visor-shaped frame parts 1, 2 placed one over the other, which can be folded against each other so that the visor remains between them, and they can be fastened to the visor and to each other by means of push-on snap-on fasteners 7, so the illuminator can be easily attached to the visor and detached from it when necessary. The visor can then be additionally coated e.g. with fabric. The electronics part 5 is connected to the back part of the frame part 1, 2, so it will not be a hindrance to the aiming of the LEDs.

Figure 2:
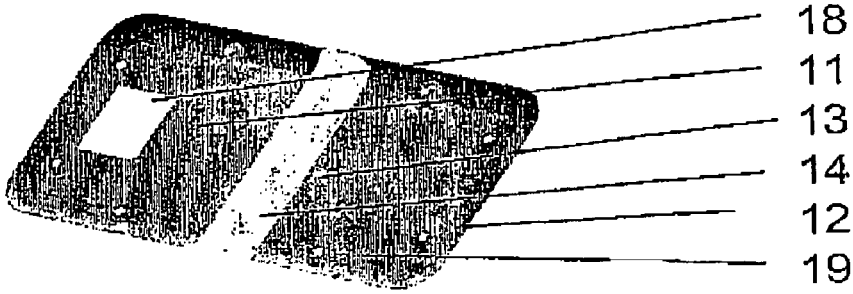
FIGS. 2 and 3 present another LED illuminator according to the invention in an opened position as seen from above and from below.
Figure 3:
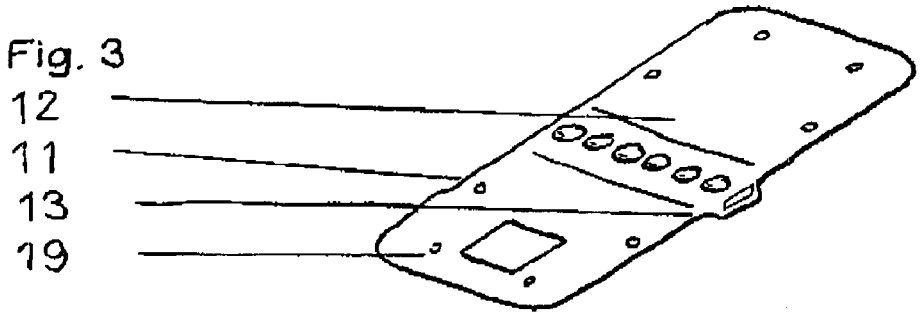
Figure 4:
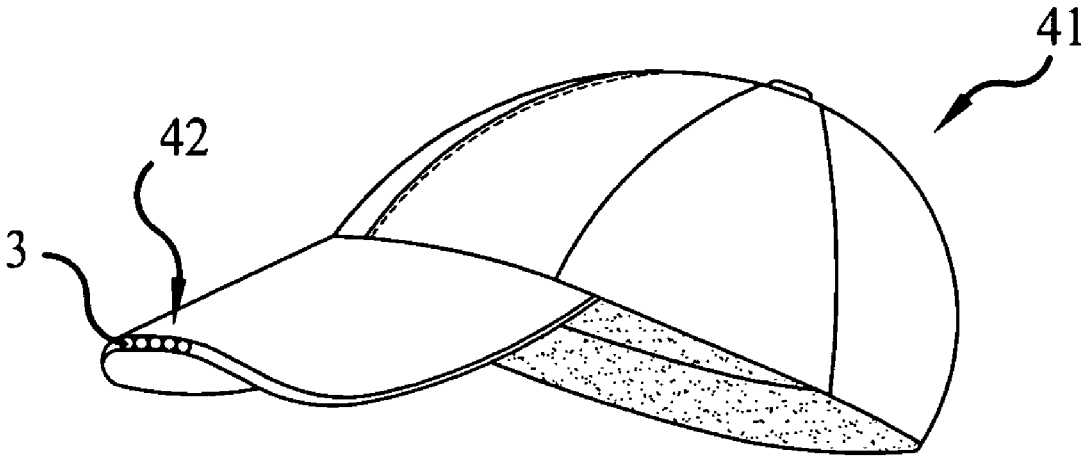
FIG. 4 presents a LED illuminator attached to a cap with a visor.

In a corresponding manner, it is possible to implement a LED illuminator (FIGS. 2-3) designed to be attached to the visor of a helmet and comprising a LED unit 13 with LEDs and rectangular frame parts 11, 12, which can be folded together in a corresponding manner and fastened by means of snap-on fasteners. The frame part can be provided with an opening 18 for the electronics part and with holes 19 for the fasteners.

The LED control electronics consist of a resistor controlling each LED, a switch and a direct-current source. The luminous efficiency of the illuminator can be varied by varying the number and luminous efficiency of the parallel LEDs.

It is obvious to the person skilled in the art that different embodiments of the invention are not limited to the example described above, but that they may be varied within the scope of the claims presented below. It may also be a water-tight (IP class 55 and upwards) encapsulated LED unit designed to be attached to protective helmets (motor vehicle drivers' helmets, miners' helmets, professional divers' helmets). The module can also be provided with UV LEDs for use by authorities (for determining the authenticity of personal documents etc. on a road, in situ). Likewise, IR LEDs can be used for special functions. The structure of the precision-directed LED unit is the same in all applications. Vertical as well as azimuth alignment is done manually.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A light-emitting diode (LED) illuminator for a headgear with a visor, said illuminator comprising:

a light-emitting diode module including a plurality of light-emitting diodes arranged as a unitary module;

a single-piece, folded frame having a first end and a second end, said plurality of light-emitting diodes being positioned adjacent to said first end for selectively emitting light therefrom, the single-piece frame having a first part and a second part, a plurality of snap-on fasteners being located on each of the first part and the second part, the snap-on fasteners on the first part respectively facing and matching the snap-on fasteners on the second part, thereby fastening the first part to the second part and forming the folded frame, the light-emitting diodes being located in a space of the folded frame between the first part and the second part; and an electronics control part for controlling the light-emitting diodes, the electronics control part including a switch, said switch being displaced towards said second end of said frame relative to the positioning of the light-emitting diodes, wherein the second part of the frame has an opening receiving the electronics control part, wherein the light-emitting diodes are fitted in the frame, side by side, adjacent to each other, said light-emitting diodes being directly operatively connected to the switch through the frame without the use of elongated wires, and wherein the light-emitting diodes and the switch are arranged integrally to the frame.

2. The LED illuminator according to claim 1, wherein the light-emitting diode module is provided with ultraviolet (UV) LEDs so that at least some of the LEDs are UV LEDs.

3. The LED illuminator according to claim 1, wherein the light-emitting diode module is also provided with infrared (IR) LEDs so that at least some of the LEDs are IR LEDs.

4. The LED illuminator according to claim 1, wherein the illuminator is an IP class 55 and upwards water-tight encapsulated LED unit.

5. The LED illuminator according to claim 1, further comprising different and differently colored light-emitting diodes which work either together or separately.

6. The LED illuminator according to claim 1, wherein the light-emitting diode module includes a rectangular module frame outside of the frame, and the light-emitting diodes are disposed within the module frame.

* * * * *